United States Patent [19]

Kodama

[11] Patent Number: 4,635,593

[45] Date of Patent: Jan. 13, 1987

[54] HYDRAULIC VALVE LIFTER

[75] Inventor: Hisashi Kodama, Nagoya, Japan

[73] Assignee: Aisin Seiki Kabushiki Kaisha, Kariya, Japan

[21] Appl. No.: 717,277

[22] Filed: Mar. 28, 1985

[30] Foreign Application Priority Data

Mar. 28, 1984 [JP] Japan ..... 59-045462[U]

[51] Int. Cl.[4] ..... F01L 1/24

[52] U.S. Cl. ..... 123/90.55

[58] Field of Search ..... 123/90.55, 90.58, 90.46

[56] References Cited

U.S. PATENT DOCUMENTS

| | | | |
|---|---|---|---|
| 4,367,701 | 1/1983 | Buente | 123/90.55 |
| 4,373,477 | 2/1983 | Buente et al. | 123/90.55 |
| 4,392,462 | 7/1983 | Leshen | 123/90.55 |
| 4,397,271 | 8/1983 | Gardner | 123/90.55 |
| 4,437,439 | 3/1984 | Speil | 123/90.55 |
| 4,465,038 | 8/1984 | Speil | 123/90.55 |
| 4,470,381 | 9/1984 | Buente et al. | 123/90.55 |

FOREIGN PATENT DOCUMENTS

| | | | |
|---|---|---|---|
| 2754446 | 6/1979 | Fed. Rep. of Germany | 123/90.55 |
| 2758957 | 7/1979 | Fed. Rep. of Germany | 123/90.55 |

*Primary Examiner*—Ira S. Lazarus

*Attorney, Agent, or Firm*—Sughrue, Mion, Zinn, Macpeak, and Seas

[57] ABSTRACT

A hydraulic valve lifter is used in the valve train of an internal combustion engine to take up the lash on operating clearance in the valve train. The valve lifter is comprised of a first cylindrical body member having a top wall, a second cylindrical body member slidably mounted within the first body member and having a bottom wall, a plunger member slidably mounted within the second body member for defining a reservoir chamber and a pressure chamber, a guide member of thick, rigid material fixed in the first body member for guiding the second body member, and a channel member of thin light weight material fixed between the first body member and the guide member for defining an oil channel connected to the reservoir chamber.

2 Claims, 2 Drawing Figures

HYDRAULIC VALVE LIFTER

BACKGROUND OF THE INVENTION

This invention relates to hydraulic valve lifters in general and more specifically to a hydraulic valve lifter for use in the valve train of internal combustion engines.

In the valve train of an internal combustion engine, a predetermined valve clearance is generally provided to compensate for thermal expansion of various parts in the valve train. However, since excessive lash may be generated due to the valve clearance in the valve train during engine operation, hydraulic valve lifters have been used for automatically taking up the valve clearance in the valve train, thereby preventing possible lash and insuring the proper engagement of the valve face with the corresponding seat.

A conventional hydraulic valve lifter of this type is disclosed, for example, in Japanese patent laid open publication No. 56-132413. FIG. 1 of the present application shows the basic construction of this conventional hydraulic valve lifter which includes a cylindrical first body member 11 in engagement with a cam shaft 12 and a second body member 13 in contact with a valve stem 14. An inner support member 15 is secured on the inner circumferential wall of the first body member 11 and is provided with a frustum or conical portion 16 and a cylindrical portion 17 in which the second body member 13 is slidably mounted. A plunger member 18 is mounted for reciprocation in the second body member 13 and is constantly biased upwardly by means of a spring 19 within the second body member 13. A pressure chamber 20 is defined between the second body member 13 and the plunger member 18 and is normally filled with hydraulic fluid such as lubricating oil. A first reservoir chamber 21 is located in the plunger member 18 and is connected to the pressure chamber 20 through a check valve 22. The reservoir chamber 21 receives a supply of lubricating oil from the engine oil pump through a radial port 23 located in the first body member 11, and oil channel 24 between the first body member 11 and the inner support member 15, and a second reservoir chamber 25 located between the frustum portion 16 and the first body member 11.

When the cam 12 moves to the lowest portion shown in FIG. 1, and downward force is transmitted to the first body member 11. The downward movement of the plunger member 18 is transmitted to the valve stem 14 through the medium of the hydraulic fluid within the pressure chamber 10. As the load of the valve spring 26 increases, the fluid pressure in the pressure chamber 20 will also increase. At this time, a slight leakage of fluid from the pressure chamber 20 occurs through a leakage clearance 27 between the plunger member 18 and the second body member 13 whereby the plunger member 18 is lowered into the second body member 13 to shorten the axial length of the valve lifter assembly 10. When the cam 12 moves upwardly from the position shown in FIG. 1, the first body member 11 is released from the downward force of the cam 12 and the load of the valve spring 26 decreases. Since the volume of the pressure chamber 20 is increased by the action of the spring 19, the fluid pressure in the pressure chamber 20 decreases, thereby permitting the check valve 22 to separate from its valve seat. As a result, the leakage through the clearance 27 is compensated thereby restoring the axial length of the valve lifter assembly 10 to the initial length.

In the conventional valve lifter assembly 10, it is apparent from FIG. 1 that the inner support member 15 secured on the inner circumferential wall of the first body member 11 is provided with the cylindrical portion 17 guiding the second body member 13 and defines the oil channel 24 supplying lubricating oil to the first reservoir chamber 21. Furthermore, the inner support member 15 is provided with the frustum portion or the conical portion 16. Therefore, when air enters into the reservoir chambers 21, 25 from the outside, the air remains above the frustum portion 16 of the inner support member 15 so that the air is not discharged to the outside through the clearance between the sliding surfaces of the cylindrical portion 17 and the second body member 13. Accordingly, since the air is intermixed with the oil in the first reservoir chamber 21, the air may further enter into the pressure chamber 20 with the result that the rigidity of the valve lifter assembly 10 will disappear and a striking sound of the engine valve will be produced. In the situation where the valve lifter 10 is mounted in an engine in an inclined condition with respect thereto, the level at which the air remains in the reservoir chamber 21 is the same level at which the check valve 22 is positioned, making it possible for air to enter into the pressure chamber 20.

SUMMARY OF THE INVENTION

An object of the present invention, therefore, is to provide a new and improved hydraulic valve lifter which eliminates the aforementioned disadvantages of the prior art hydraulic valve lifters.

More specifically, it is an object of the present invention to provide a new and improved hydraulic valve lifter wherein an upper portion of the second reservoir chamber in which the air remains can be removed.

Another object of the present invention is to provide a new and improved hydraulic valve lifter wherein the inner support member is divided into a first portion guiding a second body member and a second portion defining an oil channel, with the first and second portions being separately formed.

In one illustrative embodiment of the present invention, there is provided a hydraulic valve lifter which includes a first body member, a second body member slidably mounted within the first body member, a plunger member slidably mounted within the second body member for defining a reservoir chamber and a pressure chamber, a guide member fixed in the first body member for guiding the second body member, and a channel member fixed between the first body member and the guide member for defining an oil channel connected to the reservoir chamber; said guide member being made of relatively thick material and said channel member being made of relatively thin plate material.

Accordingly, the excessively large air spare defined by the frustum portion of the prior art inner support member can be abolished by separately forming the guide member and the channel member with the channel member formed from thin plate material which may be more readily shaped to eliminate unwanted air space. Since the channel member defining an oil channel does not need hardness or rigidity, thin plate material can be used for forming the channel member. On the other hand, the guide member needing hardness or rigidity is formed as a relatively thick member.

In accordance with another feature of the present invention, since the guide member needing rigidity is made as a thick member and the channel member is made of thin plate material, it may be possible to lighten the channel member defining the oil channel and to improve the durability of the guide member.

Other objects, features and advantages of the present invention will become more apparent upon reference to the succeeding detailed description thereof, and to the drawings illustrating a preferred embodiment.

DETAILED DESCRIPTION OF THE INVENTION

Figure 2:
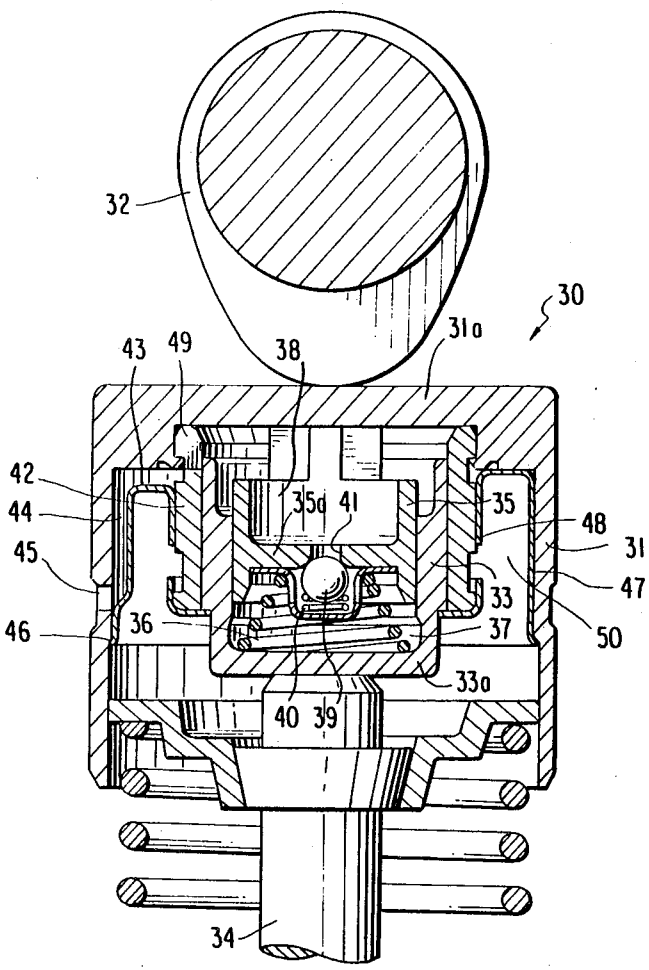
FIG. 2 is a sectional view of a hydraulic valve lifter constructed in accordance with the present invention.
Figure 1:
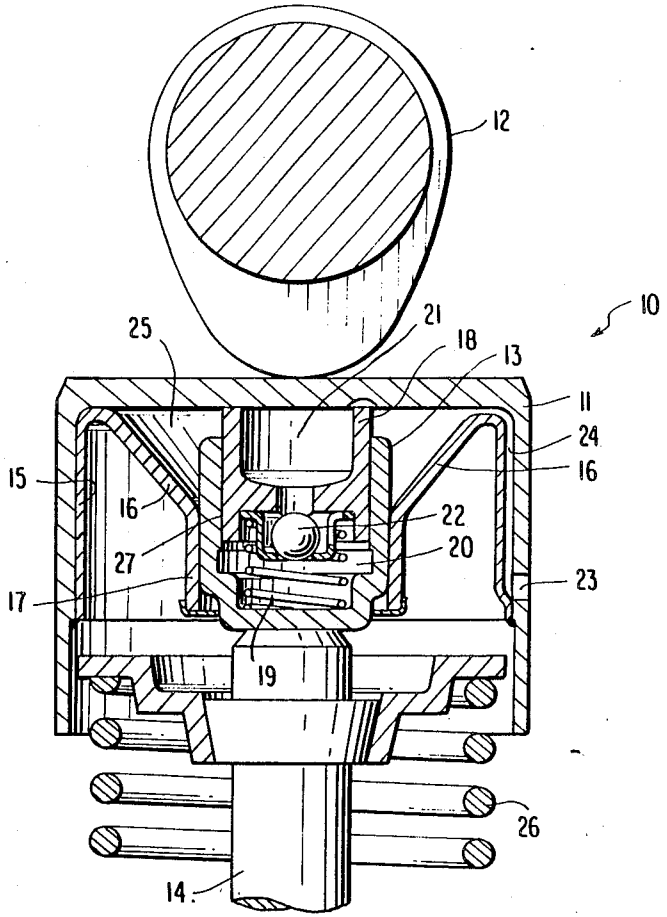
FIG. 1 PRIOR ART
FIG. 1 is a sectional view of a conventional hydraulic valve lifter.

Referring to FIG. 2, a hydraulic valve lifter 30 according to the present invention includes a first cylindrical body member 31 having a top wall 31*a* adapted to be disposed in engagement with cam shaft 32 and a second cylindrical body member 33 which is slidably mounted within the first body member 31 and which is provided with a bottom wall 33*a* adapted to be disposed in contact with a valve stem 34. A hollow plunger member 35 is mounted for reciprocation within the second body member 33 and is constantly biased upwardly by a plunger return spring 36 disposed within the second body member 33.

A pressure chamber 37 is formed between the second body member 33 and the plunger member 35. The plunger member is provided with a reservoir chamber 38 which may be disposed in fluid communication with the pressure chamber 37 through a ball check valve 39 which is normally biased into engagement with its respective valve seat by means of a spring 40. The check valve 39 allows the flow of fluid only from the reservoir chamber 38 to the pressure chamber 37 through a passage 41 formed in a bottom wall 35*a* of the plunger member 35.

An annular guide sleeve member 42 is fixed in the first body member 31 so as to guide the external circumferential surface of the second body member 33. The guide member 42 is made as a thick member so as to provide rigidity for guiding the second body member 33 and is provided with an aperture 49. A channel member 43 is fixed in the annular space 50 between the first body member 31 and the guide member 42 so as to define an oil channel 44 for supplying lubricating oil to the reservoir chamber 38 through aperture 49. The channel member 43 can be made of thin plate material because the channel member does not need rigidity. The first body member 31 is further provided with a radial port 45. The reservoir chamber 38 receives a supply of lubricating oil from the engine through the radial port 45 and the oil channel 44. Numeral 46 indicates a crimped securing portion by which the channel member 43 is fixedly secured to the first body member 31. Numerals 47, 48 indicate press fitted portions of the channel member 43 which are fixedly secured to an inner circumferential surface of the first body member 31 and to an outer circumferential surface of the guide member 42, respectively.

It will be apparent to those skilled in the art that the hydraulic valve lifter of the invention may be constructed in a variety of ways without, however, departing from the scope and spirit of the appended claims.

What is claimed is:

1. A hydraulic valve lifter for use in a valve train of an internal combustion engine, said lifter comprising:

a first cylindrical body member having an inner cylindrical wall with an inlet port extending therethrough and having a top wall adapted to be disposed in engagement with a cam shaft;

an annular guide sleeve fixed in said body member in spaced relation to said cylindrical wall to define an annular space therebetween;

a second cylindrical body member having a bottom wall mounted for reciprocation within said annular guide sleeve, said bottom wall adapted to be in contact with a valve stem;

a plunger member mounted for reciprocation within said second body member;

spring means biasing said plunger member towards said top wall;

said plunger member and said second body member defining a pressure chamber;

said plunger member defining a reservoir chamber therein;

first fluid passage means extending between said reservoir chamber and said annular space;

second fluid passage means interconnecting said reservoir chamber and said pressure chamber;

check valve means associated with said fluid passage means for permitting fluid flow only from said reservoir chamber to said pressure chamber;

an annular channel member having an inverted U-shaped cross section secured between said cylindrical wall and said guide sleeve and defining an oil chamber extending between said inlet port and said first fluid passage means wherein said guide sleeve is comprised of a relatively thick member for obtaining rigidity and said annular channel member is made of relatively thin plate material for easy shaping and weight reduction.

2. A hydraulic valve lifter as set forth in claim 1 wherein said annular channel member is press fitted into said annular space and is additionally secured therein by crimping means.

* * * * *